United States Patent [19]

Stankowitz

[11] 4,015,543

[45] Apr. 5, 1977

[54] PLATFORM SUPPORT STRUCTURE

[76] Inventor: Arthur J. Stankowitz, 2905 Summit Ave., Union City, N.J. 07087

[22] Filed: Oct. 29, 1974

[21] Appl. No.: 519,049

[52] U.S. Cl. ..... 108/27; 108/108; 108/152; 211/88; 248/243

[51] Int. Cl.[2] ..... A47B 17/00

[58] Field of Search ..... 108/27, 152; 248/243, 248/250, 310, 314; 211/88, 153; 249/85; 264/273, 275

[56] References Cited

UNITED STATES PATENTS

| | | | |
|---|---|---|---|
| 2,991,038 | 7/1961 | Vitiello | 248/250 X |
| 3,184,200 | 5/1965 | McDonnell | 248/243 |
| 3,330,004 | 7/1967 | Cloyd et al. | 264/275 X |
| 3,504,832 | 4/1970 | Corvetti | 211/88 |
| 3,587,181 | 6/1971 | Bernier | 264/275 |
| 3,704,675 | 12/1972 | Bellasaima | 108/152 |
| 3,754,518 | 8/1973 | Wachtel | 108/152 |
| 3,832,957 | 9/1974 | Mendenhall | 108/108 |

*Primary Examiner*—James C. Mitchell
*Attorney, Agent, or Firm*—Hopgood, Calimafde, Kalil, Blaustein & Lieberman

[57] ABSTRACT

A platform support structure includes a platform having an upper support surface and a lower surface. A slot extends into the lower platform surface and an elongated support bracket includes a portion which is integral with the platform within the slot so that the sides of the slot cooperate with a portion of the sides of the bracket to provide lateral support for the platform.A raised wall member extends outwardly and annularly from the upper surface of the platform to provide a continuous moment sufficiently distal from the slot to overcome anticipated breaking moments at the slot.

5 Claims, 4 Drawing Figures

FIG. 1
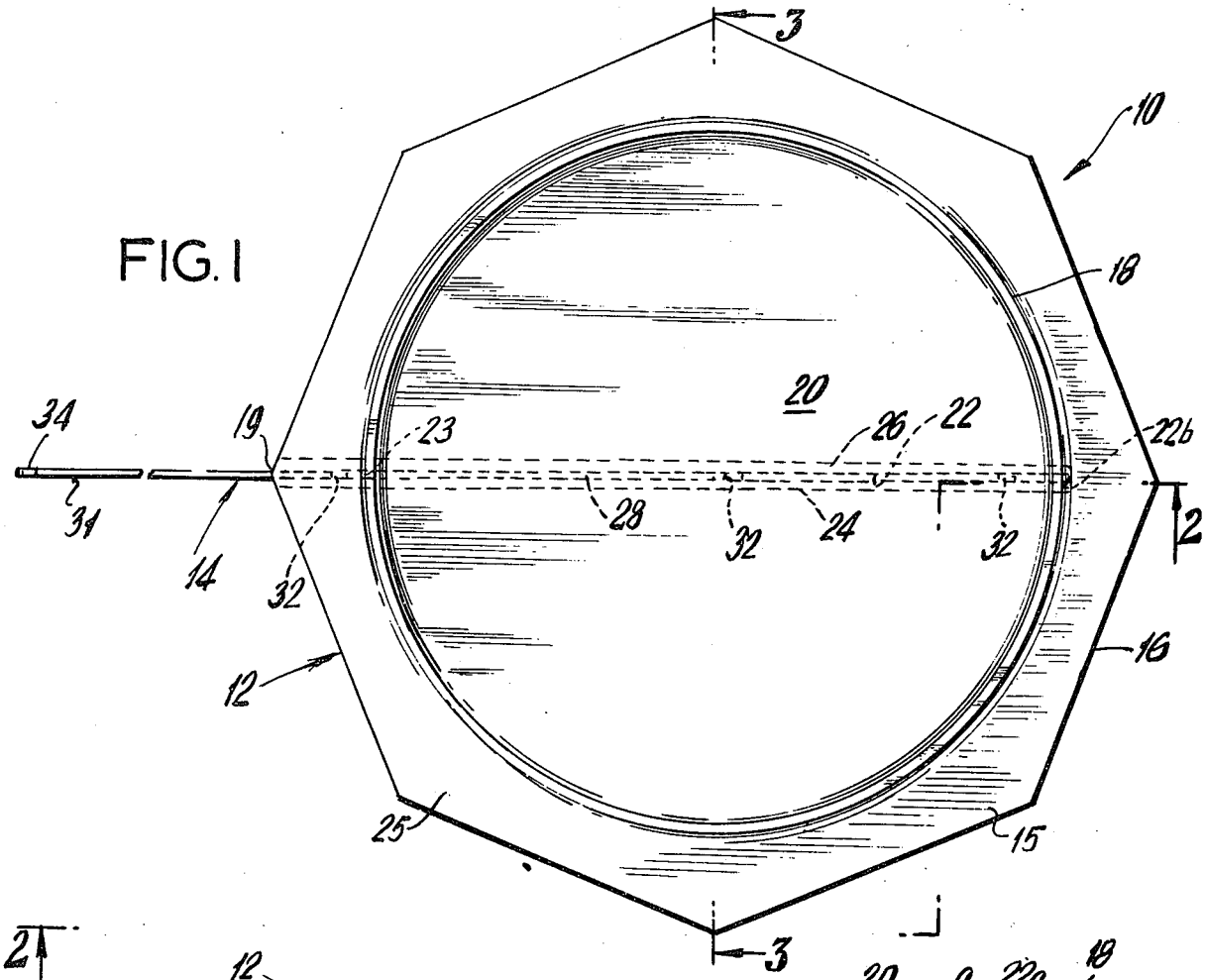
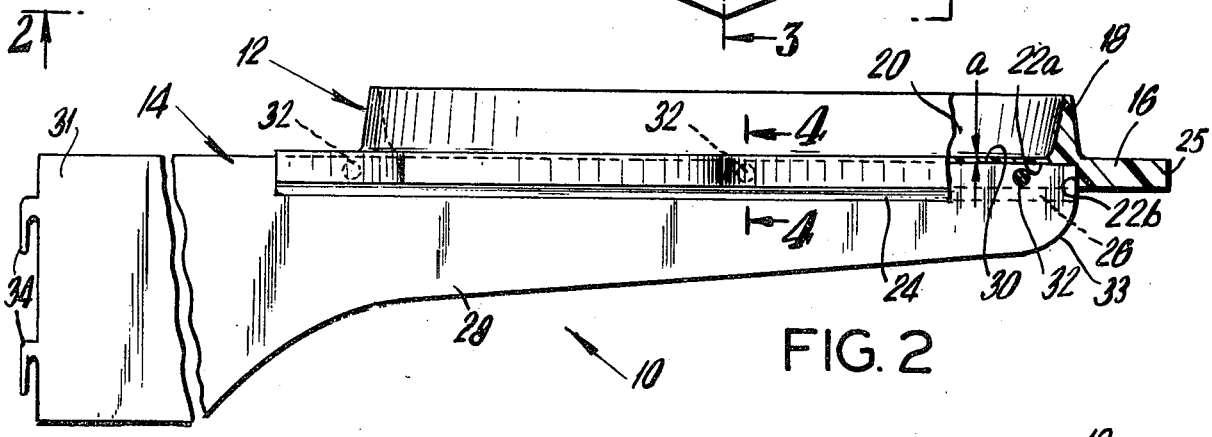
FIG. 2
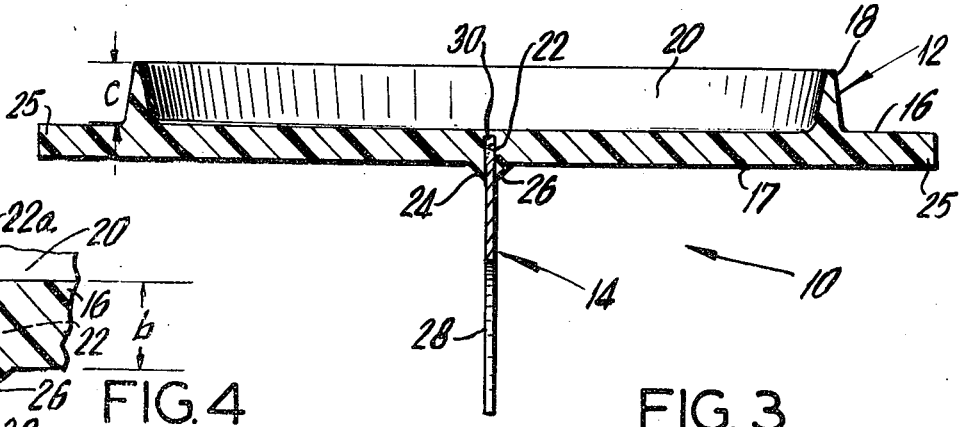
FIG. 3
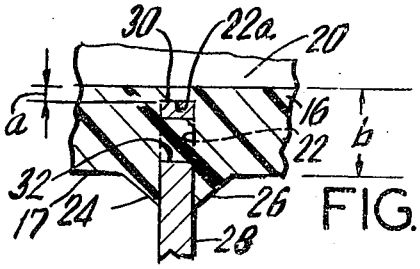
FIG. 4

PLATFORM SUPPORT STRUCTURE

BACKGROUND OF THE INVENTION

It is often desirable to mount a platform for the support of plants or other decorative objects on cantilever brackets which extend outwardly from a vertically oriented support structure such as a wall or one or more stanchions. Wall systems often found in homes or apartments include stanchions having a plurality of means to mount cantilever brackets at various vertical heights to provide means for the decorative arrangement of shelves and platforms.

The brackets customarily used in mounting platforms of this type are relatively narrow and enlongated both for reasons of esthetics and economy of manufacture so that they provide only a very small upper support surface. If the shelf or platform is supported by several brackets at two or more spaced points along its length the lack of upper support surface on each bracket provides no problem since the platform or shelf will be prevented by the multiple support points from rotating laterally about the supporting brackets. If however one wishes to support a platform by a single narrow bracket of the type described above the problem of providing adequate lateral stability for the platform becomes formidable.

One solution to this problem is to provide a slot extending into the platform through its lower surface and inserting the upper portion of the support bracket into this slot to provide the needed lateral support. The longitudinal sides of the slot will bear against the longitudinal sides of the bracket to prevent the platform from rotating about the bracket. The amount of lateral support provided by this arrangement will be dependent upon the depth to which the slot extends into the body of the platform. If however the slot extends far enough into the body of the platform to provide adequate lateral support it will decrease the depth of the platform in the area above the slot and thereby create a weakened area in the platform. There will then be a high probability that the platform will break or crack along this weakened area. The alternative of course is to increase the thickness but in volume this is expensive.

The present inventive platform support structure provides adequate lateral support for a platform supported by a single elongated supporting bracket with a narrow support surface without unduly weakening the platform. The inventive structure thereby provides cost savings by permitting a single bracket to do the work of at least two and also permits more flexible and esthetically pleasing mounting arrangements. Accordingly, it is the object of this invention to provide a platform support structure sufficiently rigid and rugged so as to resist turning and breaking moments, yet be economical to manufacture and esthetically pleasing.

SUMMARY OF THE INVENTION

A platform support structure includes a platform having a first and second substantially parallel opposed surfaces. An elongated slot extends into the platform from the second surface and terminates a predetermined minimum distance below the first surface. The first surface includes a raised annular wall member extending outwardly a second predetermined distance from the first surface at least a portion of this wall member being arranged vertically above at least a portion of the elongated slot. An elongated bracket has opposed longitudinal sides and a narrow support surface. This bracket is mounted so that at least a portion of the longitudinal sides of the bracket extend into the elongated slot in the platform to provide lateral support for the platform.

DESCRIPTION OF THE DRAWINGS

FIG. 1 is a top plane view of the inventive platform support structure.

FIG. 2 is a side elevational view of the inventive structure in partial section taken along plane 2—2 of FIG. 1.

FIG. 3 is a sectional view of the inventive structure taken along plane 3—3 of FIG. 1.

FIG. 4 is an enlarged fragmentary section taken along plane 4—4 of FIG. 2.

DESCRIPTION OF THE INVENTION

The inventive platform support structure 10 is shown in its entirety in FIG. 1 and includes a substantially planar platform 12 and a cantilever bracket 14 arranged to support the platform 12. The platform 12 comprises a substantially planar base portion 16 having substantially parallel lateral surfaces 15 and 17. A raised annular wall 18 is provided on a portion of the upper surface 15 of platform 12. The wall 18 is preferably adjacent to the periphery of platform 12 and surrounds a central area 20 on the upper surface 15.

The lower surface 17 of the platform 12 includes an elongated slot 22 in the body of the platform 12 so that the top 22*a* of slot 22 is substantially parallel to and spaced a distance (*a*) beneath the upper surface 15 of the platform. The slot 22 is configured to fit snugly about the bracket 14 so that the longitudinal sides of the bracket cooperate with the longitudinal sides of the slot 22 to provide lateral support for the platform 12. The slot 22 extends through the periphery of the base portion 16 at a point 19 on one side of the platform 12 and extends transversely across the platform 12 to a point 22*b* as seen in FIG. 1. Point 22*b* is adjacent to the periphery on the opposite side of platform 12 and is arranged vertically below a portion of the annular wall 18. Alternatively the slot could extend completely across the platform.

Preferably, wedge shaped elongated projections 24 and 26 extend downwardly from the bottom surface 17 of the base portion 16 of platform 12 for added support. The inner surfaces of projections 24 and 26 are in contact with the opposed longitudinal sides of the bracket 14 along that portion of the bracket which is mounted within slot 22.

The bracket 14, as best shown in FIG. 2, is a conventional elongated beam having opposed parallel longitudinal sides and a narrow linear upper support surface 30. A first wider end 31 of bracket 14 includes mounting means such as hooks 34 which are insertable into mounting apertures in a conventional stanchion or other supporting structure which is not shown. The lower edge 28 of bracket 14 curves upwardly from wider end 31 to the narrower unsupported end 33 to provide a centilever supporting structure. A number of apertures 32 extend transversely through bracket 14 at points adjacent to the upper support surface 30. The purposes of these apertures will be explained below.

The inventive structure 10 permits the platform 12 to be supported by a single cantilever bracket 14 in a manner such that maximum lateral stability is provided to the platform by the cooperation of slot 22 in the platform and the longitudinal sides of bracket 14. I have found, for reasons to be explained, that platform volume (material) can be minimized and the distance (*a*) between the top 22*a* of slot 22 and surface 15 reduced to between ⅓ and 1/50 of the total thickness of base portion 16. Since the bracket 14 extends at least ⅔ of the way through the thickness of the base portion 16 of the platform 12 and is configured to fit snugly within the slot 22, the structure inherently provides a great deal of resistance to the lateral movement of platform 12 about bracket 14. The wedge shaped projections 24 and 26 extending along the respective sides of the bracket 14 increase the area of the longitudinal sides of the bracket 14 which are in contact with the base portion 16 of the platform to provide even greater resistance to the pivoting of the platform about the narrow bracket support surface 30 and thereby further improve the lateral stability of the platform.

Since the slot 22 extends at least ⅔ of the way through the both of platform 12 it naturally creates a weak point in the platform which can cause the platform to break if the load is distributed unevenly on its upper surface 15. The presence of annular wall 18 provides an annular moment arm which concentrates the platform material at the probable rupture point for uneven loads, but with minimum extra material. As can best be seen in FIG. 3 annular wall member 18 extends a distance (*c*) upwardly from the upper platform surface. This distance is preferably equal to or greater than the thickness (*b*) of the platform base portion 16 as best seen in FIG. 4. The annular wall member 18 and the slot 22 are arranged so that the wall member 18 is above the slot 22. While preferably annular the raised wall 18 can be any shape desired so long as a portion of the wall 18 is arranged above the slot 22 to provide a moment arm resisting rupture at the slot.

A part 25 of base portion 16 as seen in FIGS. 2 and 3 extends outwardly beyond the end of 22*b* of the slot 22 to provide an additional area of strength about the periphery of the platform. In this area 25 of the base portion 16 the platform is not weakened by the presence of the slot 22. The presence of this unweakened area 25 provides even further resistance to breakage along slot 22.

As previously indicated bracket 14 may include one or more spaced apertures 32 arranged adjacent to that portion of its upper surface 30 which extend into slot 22. In manufacturing the inventive structure the platform may be molded of a plastic material such as polyurethane formed about the bracket 14. The slot 22 will then be created during the molding process so that the walls of the slot 22 will be contiguous with the longitudinal sides of bracket 22. During molding the plastic material will also penetrate through the apertures 32 so that the body of the platform 12 will physically extend through the bracket 14 at apertures 32. This will prevent the platform from sliding off the bracket and will further increase the lateral stability of the platform and its resistance to breakage about the area of the slot 22.

It can therefor be readily seen that the inventive structure disclosed provides a cantilever supported platform member having both maximum lateral stability utilizing a single support member of minimum width and a large resistance to cracking above the weak point created by the slot within which the support member is mounted.

Although the present invention has been described in conjunction with preferred embodiments, it is to be understood that modiciations and variations may be restored to without departing from the spirit and scope of the invention as those skilled in the art will readily understand. Such modifications and variations are considered to be within the purview and scope of the invention and appended claims.

I claim:

1. A platform support structure including in combination:

a platform member having a first and a second substantially parallel opposed surfaces with a predetermined thickness therebetween; said second surface having a narrow elongated slot extending into said platform member a distance equal to at least two thirds of said predetermined thickness; said first surface of said platform structure including a raised wall member extending outwardly from said first surface a distance equal to at least said predetermined thickness, at least a portion of said wall member being arranged vertically above at least a portion of said elongated slot;

an elongated support member having two opposed longitudinal sides with a narrow lateral support surface extending therebetween, at least a portion of said support surface and the adjacent longitudinal sides of said support member being mounted snugly within said elongated slot; and two elongated projections extending outwardly from said second surface, one of said elongated projections being arranged respectfully adjacent to at least a portion of each side of said elongated slot and each of said projections including a surface which is contiguous with at least a portion of one of said opposed longitudinal sides of said support member.

2. A platform support structure as claimed in claim 1 in which said slot terminates a distance less than one third of said predetermined thickness from said first surface.

3. A platform structure as claimed in claim 1 in which said elongated support member has at least one transverse aperture in said portion of said support member which is mounted within said elongated slot and in which a portion of the material of said platform structure extends through said aperture in said support member and across said slot in said platform member.

4. A platform structure as claimed in claim 1 in which the slot in said second surface of said platform structure passes through the periphery of said structure on a first side and extends transversely across said platform structure to a point adjacent to periphery of said platform structure at a side opposite said first side; and in which said elongated support structure is a cantilever beam having a first and a second end, said beam being adopted to be supported at said first end, a portion of said beam including said second end being mounted within said elongated slot to provide support for said platform structure and said raised wall structure being an annular wall arranged so that at least a portion of said wall is vertically above said second end of said support beam when said beam is mounted in said elongated slot.

5. A platform support structure including in combination:

a platform member having a first and second substantially parallel opposed surfaces and a predetermined thickness between said surfaces; said second surface having an elongated slot extending into said platform member a distance equal to at least two thirds of said predetermined thickness;

a raised wall member on said first surface of said platform member adjacent to the periphery of said platform member, said wall member extending outwardly from said first surface a distance at least equal to said predetermined thickness, and at least a portion of said wall member being arranged vertically above at least a portion of said elongated slot to strengthen the platform along said portion of said slot;

an elongated support member having two opposed longitudinal sides with a narrow lateral support surface extending therebetween, at least a portion of said support surface and the adjacent longitudinal sides of said support member being mounted snugly within said elongated sides; and two elongated projections extending outwardly from said second surface, one of said elongated projections being arranged respectfully adjacent to at least a portion of each side of said elongated slot and each of said projections including a surface which is contiguous with at least a portion of one of said opposed lateral sides of said support member.

* * * * *